US011846070B2

(12) United States Patent
Martineau et al.

(10) Patent No.: US 11,846,070 B2
(45) Date of Patent: Dec. 19, 2023

(54) SCREEN CYLINDER

(71) Applicant: AIKAWA FIBER TECHNOLOGIES OY, Varkaus (FI)

(72) Inventors: Benoit Martineau, Magog (CA); Israel Paquette, Sherbrooke (CA); Christophe Roger Hayart, Québec (CA); Robert William Gooding, Montreal (CA)

(73) Assignee: AIKAWA FIBER TECHNOLOGIES OY, Varkaus (FI)

( * ) Notice: Subject to any disclaimer, the term of this patent is extended or adjusted under 35 U.S.C. 154(b) by 696 days.

(21) Appl. No.: 17/023,485

(22) Filed: Sep. 17, 2020

(65) Prior Publication Data

US 2021/0047778 A1 Feb. 18, 2021

Related U.S. Application Data

(63) Continuation of application No. PCT/FI2020/050521, filed on Aug. 6, 2020.

(30) Foreign Application Priority Data

Aug. 16, 2019 (FI) ..... 20195686

(51) Int. Cl.
*D21D 5/16* (2006.01)

(52) U.S. Cl.
CPC ..... *D21D 5/16* (2013.01)

(58) Field of Classification Search
CPC . B07B 1/20; B07B 1/18; D21D 5/026; D21D 5/023; D21D 5/16; B21D 5/023; B21D 5/16

(Continued)

(56) References Cited

U.S. PATENT DOCUMENTS 3,667,615 A 6/1972 Likness
4,529,520 A 7/1985 Lampenius (Continued)

FOREIGN PATENT DOCUMENTS

CA 2178683 A1 4/1997
CA 2965065 A1 7/2010

(Continued)

OTHER PUBLICATIONS

International Search Report and Written Opinion of the International Searching Authority for International Application No. PCT/FI2020/050521 dated Nov. 19, 2020.

(Continued)

*Primary Examiner* — Michael McCullough
*Assistant Examiner* — Jessica L Burkman
(74) *Attorney, Agent, or Firm* — HESLIN ROTHENBERG FARLEY AND MESITI PC; Nicholas Mesiti

(57) ABSTRACT

The present invention relates to a screen cylinder that is particularly suitable for screening, filtering, fractionating, or sorting cellulose pulp or fibre suspensions of the pulp and paper industry or other similar suspensions. The present invention relates more particularly to screening devices, which are usually cylindrical though also conical shapes are known. Such screening devices have basically two optional constructions. A first one comprises a plurality of screen wires positioned substantially axially and at a small spacing parallel to each other. The plurality of screen wires forms a screening surface facing the pulp or fibre suspension to be screened and adjacent wires form screening openings therebetween allowing an accept portion of the pulp or fibre suspension to flow therethrough. The second construction comprises a drilled or slotted sheet metal plate bent to a circular, or in broader terms, rotationally symmetrical shape.

21 Claims, 8 Drawing Sheets

(58) Field of Classification Search
USPC ..... 209/406
See application file for complete search history.

(56) References Cited

U.S. PATENT DOCUMENTS

| | | | |
|---|---|---|---|
| 4,846,971 | A | 7/1989 | Lamort |
| 5,472,095 | A | 12/1995 | Malm |

FOREIGN PATENT DOCUMENTS

| | | | |
|---|---|---|---|
| JP | 2003201691 | A | 7/2003 |
| TW | 201546346 | A | 12/2015 |

OTHER PUBLICATIONS

Search Report for Finnish Patent Application No. 20195686 dated Mar. 4, 2020.
Office Action for Finnish Patent Application No. 20195686 dated Mar. 4, 2020.

SCREEN CYLINDER

CROSS REFERENCE TO RELATED APPLICATIONS

The present disclosure is a continuation of International Application No. PCT/FI2020/050521, filed on Aug. 6, 2020, which claims priority of Finnish Patent Application No. 20195686, filed on Aug. 16, 2019. The disclosures of each of the prior applications are incorporated herein by reference in their entirety.

FIELD OF THE INVENTION

The present invention relates to a screen cylinder that is particularly suitable for screening, filtering, fractionating, or sorting cellulose pulp or fibre suspensions of the pulp and paper industry or other similar suspensions. The present invention relates more particularly to screening devices, which are usually cylindrical though also conical shapes are known. Such screening devices have basically two optional constructions. A first one comprises a plurality of screen wires positioned substantially axially and at a small spacing parallel to each other. The plurality of screen wires forms a screening surface facing the pulp or fibre suspension to be screened and adjacent wires form screening openings therebetween allowing an accept portion of the pulp or fibre suspension to flow therethrough. The second construction comprises a drilled or slotted sheet metal plate bent to a circular, or in broader terms, rotationally symmetrical shape.

BACKGROUND OF THE INVENTION

The pulp screening process is most typically directed to the removal of oversize contaminants from a slurry of pulp fibres. Screening is often accomplished by a series of screening operations, with each successive operation generally having smaller apertures. In this way, the first screening operation, which may be called coarse screening, will remove very large, aggressive contaminants. Flakes of pulp can also be broken apart in this operation, which is a process called deflaking, to yield useful fibre. This coarse screening operation requires very durable screen rotor and screen cylinder constructions so that they can survive the impact of large and/or aggressive contaminants such as rocks, sand, knots, metal pieces, etc. Once these contaminants are removed and the flakes are dispersed, the pulp can pass to a so-called fine screening operation that is specifically engineered to make a more precise separation between the smaller debris and the pulp fibres. Nowadays both wedge-wire screen cylinders and drilled or slotted sheet-metal cylinders may be found in the various screening operations. A typical wedge-wire screen cylinder, illustrated schematically in FIG. 1, is formed of a plurality of parallel, generally axially-oriented, wedge wires fastened on a plurality of circumferentially-running support rings, the ends of the cylinder being provided with end rings to which the wedge wires are also fastened either directly or indirectly and via which the cylinder is coupled to the actual pulp screen. A typical slotted or drilled screen cylinder is formed of a sheet metal plate provided with drilled or otherwise perforated holes or machined slots. The slots may extend in an axial or non-axial direction. The drilled or slotted sheet metal plate is bent into a cylindrical, or rotationally-symmetrical, shape and provided with, usually, but not always necessarily, support rings, and end rings via which the cylinder is coupled to the actual pulp screen.

U.S. Pat. No. 5,472,095 discloses a screen cylinder formed of longitudinal, i.e. axially-oriented wedge wires separated by gaps or screening openings, and support rings extending around the circumference of the cylinder to support the wedge wires, as well as longitudinal strips or disruptor bars whose outer surfaces (i.e. surfaces away from the support rings) are at a greater distance from the support rings than are those of the wedge wires. FIGS. 2*a*, 2*b*, 3 and 4 disclose screen cylinders with such strips or disruptor bars located between or on top of the wedge wires.

The above mentioned US-patent also shows so-called contours, i.e. regularly appearing "hills and valleys", that are created on the feed-side face or screening surface of the screen cylinder by the shape of the individual wedge-wire cross-sections. Similar contours may also be found at the feed-side face of drilled or slotted screen cylinders as shown in U.S. Pat. No. 4,529,520. The phrase 'profiled screen plate' is sometimes used to refer to the contoured surface. These contours are intended to increase screen capacity by one or more of the following actions: 1) creating turbulence in the feed-side flow to disperse fibre flocs, and to remove any material that is immobilized at the slot entry, 2) streamlining the flow stream that passes through the slots, and 3) moving the location of the flow bifurcation point away from the slot entry to a location where fibres are less likely to accumulate.

Disruptor bars used in connection with both drilled or slotted screen cylinders and screen cylinders made of wedge wires are typically square or rectangular in cross-section and are most commonly separately formed and attached by their foot part to the feed-side face of the screen cylinder, the feed-side face being either formed of the surface of drilled/slotted sheet-metal plate or by the assembly of wedge wires. The disruptor bars may also act to induce turbulence, but their intent is directed mainly to one or more of the following actions: 1) dispersing fibre flakes to their constituent fibres in the so-called "deflaking" process, 2) breaking up any large agglomeration of strings and other large contaminants, 3) protecting the wedge wires from large contaminants that might otherwise strike and damage the wedge wires and 4) for inclined and spiral disruptor bars, directing the large contaminants to the reject outlet of the screen.

An essential part of the action of a disruptor bar is the presence of an active edge, which is the corner edge of the bar where the flow impinges, and which provides the localized force to the impinging large contaminants, agglomerations or flakes that will cause them to be weakened or broken apart. For a typical disruptor bar in a typical screen, where the flow is driven by the rotor and is largely circumferential, there is only one active edge.

JP2003/201691 discloses a screen cylinder formed of a plurality of screen wires or wedge wires connected to a plurality of locking portions, i.e. notches, in support rings.

U.S. Pat. No. 4,846,971 discloses a sieve which is produced by mechanical interfit between screen wires and support members, with both the screen wires and the support members being provided with notches which fit together when the screen cylinder is assembled.

There are problems with the current practice, i.e. the current design of coarse screen cylinders with wedge wires, as well as drilled and milled screen cylinders, and with disruptor bars. In many cases the problems exist to the extent that the coarse screen cylinder is manufactured without disruptor bars. The main problems that are addressed by the current invention are as follows:

Deflaking can be difficult to measure, and it may be difficult to observe any significant degree of deflaking with cylinders that have relatively few disruptor bars. Increasing the number of disruptor bars is thought to increase the degree of deflaking but at the expense of a significant increase in power consumption.

Runnability is a term used to describe the ability of the screen to maintain capacity even with the inevitable fluctuations in the debris content, fibre character, pulp consistency and other process variables. The disruptor bars, along with the screen contours and screen rotor action, are part of the approach to increasing runnability, for example in breaking up an agglomeration of large, stringy debris, but improvements in runnability can be difficult to measure, and in some cases, the simple rectangular shape of the disruptor bar may not provide the turbulence and fluid action needed.

The large, aggressive contaminants that are typical of coarse screening applications will impact the active edge of the typical current disruptor bars, which are typically separately formed and welded to the surface of the screen cylinder, and in some cases the large impacts can cause welds to crack and the bars to break.

The presence of the disruptor bars can lead to flow patterns such as bound vortices that may lead to accelerated wear immediately downstream of the disruptor bar. This wear may lead to slots becoming wider, thus allowing oversize debris to pass. In the extreme, the screen cylinder will wear through completely, weakening the cylinder and allowing even more debris to pass.

BRIEF DESCRIPTION OF THE INVENTION

An object of the present invention is to provide a screen cylinder to overcome at least one of the above problems as well as to alleviate the above disadvantages.

The object of the invention is achieved by an arrangement which is characterized by what is stated in the independent claim. The preferred embodiments of the invention are disclosed in the dependent claims.

The invention is based on the idea of a screen cylinder, which possesses at least one disruptor bar having a complex 3-dimensional shape.

An advantage of the screen cylinders of the present invention is that the specifically-designed at least one disruptor bar generates a favourable flow pattern as well as provides additional support and strength to the screen cylinder. The at least one disruptor bar may also be shaped to avoid the downstream bound vortex and the accelerated wear in that location.

A screen cylinder of the present invention comprises a cylindrical screening media provided with perforations, end rings fastened to opposite axial ends of the cylindrical screening media, the cylindrical screening media having a feed-side face and an exit-side face, the feed-side and said exit-side faces extending in a circumferential direction, and the cylindrical screening media being provided with at least one disruptor bar at the feed-side face thereof, the disruptor bar extending in a mainly longitudinal direction on the cylindrical screening media, the at least one disruptor bar having a foot part and a head part, the foot part and the head part forming radially-opposite ends of the disruptor bar, the at least one disruptor bar being formed separately from and fastened to the cylindrical screening media by means of its foot part, the screen cylinder further comprising two or more active edges (E1, E2, E3, E4, E5, E6) provided in a cross-section of the head part of the at least one disruptor bar, the cross-section being taken in a direction perpendicular to a longitudinal axis of the at least one disruptor bar. These two or more active edges may present themselves relative to a circumferential flow, but they may also present themselves to the axial or some other direction of the flow, respecting the other flow components and turbulent flows which will cause motion other than in a simple circumferential direction.

In another embodiment of the invention, the two or more active edges (E1, E2, E3) are formed by a surface facing, at least in part, towards the circumferential direction of flow and a surface facing, at least in part, towards the radial direction (perpendicular to the flow direction) away from the screening media.

In another embodiment of the invention the two or more active edges (E4, E5, E6) are formed by a surface facing, at least in part, in the circumferential direction away from the direction of flow and a surface facing, at least in part, towards the radial direction (perpendicular to the flow direction) away from the screening media.

In another embodiment of the invention the two or more active edges (E1, E2, E3, E4, E5, E6) extend in the longitudinal direction of the at least one disruptor bar.

In another embodiment of the invention the active edges at the head part of the at least one disruptor bar are at least partially-raised above the generally cylindrical feed-side face of the cylindrical screening media.

In another embodiment of the invention the at least one disruptor bar is formed of at least two parts fastened to one another.

The at least one disruptor bar may be connected to the screen cylinder in several different ways. Different ways to connect the at least one disruptor bar provide additional strength and support to the screen cylinder depending on the need.

In one embodiment of the invention the wedge wires are supported by a plurality of support rings forming a support structure to support the wedgewire screening media, each support ring having a notched circumference with notches for the wedge wires.

In another embodiment of the invention the at least one disruptor bar is fastened on the feed-side face of the screening media.

In another embodiment of the invention the at least one disruptor bar is attached onto the wedge wires.

In another embodiment of the invention said at least one disruptor bar is attached, at its foot part, to the end rings, preferably to notches in the end rings.

In another embodiment of the invention the at least one disruptor bar is fastened to the support ring between wedge wires, preferably to a notch in the support ring.

In at least one embodiment, the disruptor bar is distinct and formed separately from, and attached to, a support structure via support rings, the wedge wire, or on the face of a drilled or slotted screening medium.

In another aspect, the invention includes a disruptor bar for a screen cylinder of the type having a cylindrical screening media provided with perforations, where the end rings are fastened to opposite axial ends of the cylindrical screening media, and the cylindrical screening media has a feed-side face and an exit-side face, the feed-side and said exit-side faces extending in a circumferential direction. The at least one distributor bar is to be mounted at the feed-side face of the cylindrical screening media and extending in a mainly longitudinal direction on the cylindrical screening media. The at least one disruptor bar having a foot part and a head part, the foot part and the head part forming radially opposite ends of the disruptor bar, the at least one disruptor bar to be fastened to the cylindrical screening media by means of its foot part, the distributor bar further comprising two or more active edges (E1, E2, E3, E4, E5, E6) provided in a cross-section of the head part of the at least one disruptor bar, the cross-section being taken in a direction perpendicular to a longitudinal axis of the at least one disruptor bar.

In one or more embodiments, the distributor bar may include some or all of the aforementioned features discussed above and herein, in any combination.

In at least one embodiment, the at least one disruptor bar is configured to be attached onto the wedge wires.

In at least one embodiment, the at least one disruptor bar is configured to be fastened to the support ring between wedge wires.

In at least one embodiment, the disruptor bar is configured wherein the foot part fits within a notch in the support ring of the screen cylinder.

In at least one embodiment, the disruptor bar is configured wherein the foot part is configured to fit within a notch in one or more of the end rings of the screen cylinder.

In at least one embodiment, the disruptor bar is distinct and formed separately from, and attached to, a support structure via support rings or on the screening media.

BRIEF DESCRIPTION OF THE DRAWINGS

In the following, the present invention will be described in greater detail by means of preferred embodiments with reference to the accompanying drawings, in which.

DETAILED DESCRIPTION OF THE INVENTION

Figure 1:
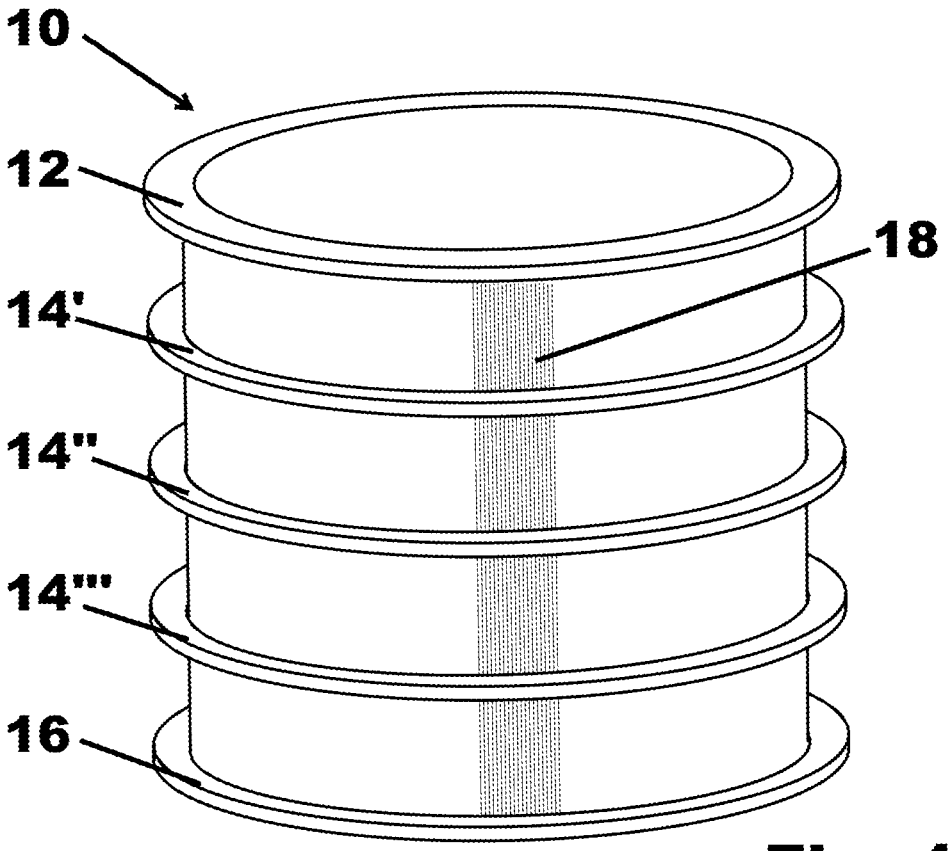
Fig. 1 Prior Art
FIG. 1 illustrates a conventional outflow wedge wire screen cylinder.
Figure 2A:
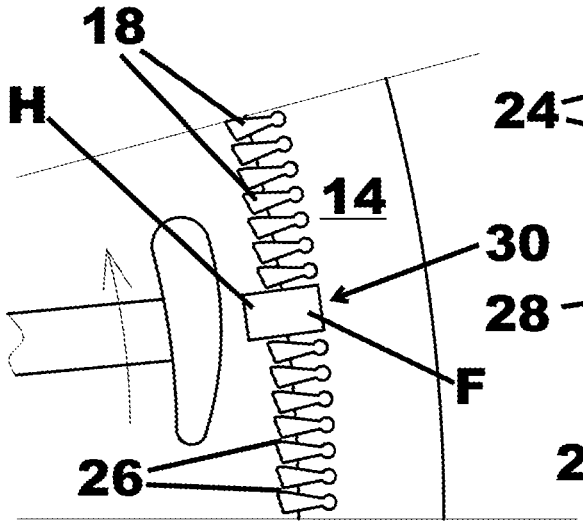
Fig. 2a Prior Art
FIG. 2*a* illustrates a partial section of a pressure screen, i.e. showing a section of a screen cylinder and a rotor cooperating therewith.
Figure 2B:
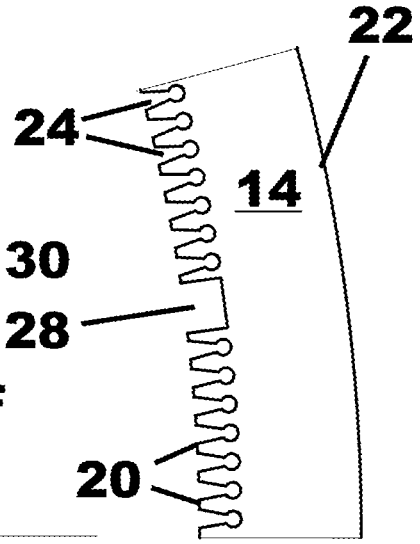
Fig. 2b Prior Art
FIG. 2*b* illustrates a partial section of a support ring used to support both the wedge wires and the disruptor bar shown in FIG. 2*a;*

FIGS. 1, 2*a* and 2*b* illustrate schematically a conventional prior art outflow wedge wire screen cylinder 10 comprising five coaxial annular support structures 12, 14', 14", 14'" and 16, and wedge wires 18 fastened to the support structures, the support structures 14', 14" and 14'" having a radially notched circumference 20 and a radially solid circumference 22. Support structures 12 and 16 are the top and the bottom support structures or top and bottom end rings and support structures 14', 14" and 14'" are normally called support rings that form a support structure and support the wedge wires or the perforated sheet metal plate between the end rings. The actual number of support rings 14 depends on the length of the screen cylinder and may easily exceed 10. A plurality of wedge wires 18 is connected or clamped to notches 24 in the annular support rings 14', 14", 14'" so that the plurality of wedge wires 18 extend to a first predetermined distance from a radially notched circumference 20 of the support rings 14 and so that gaps or screening openings or slots 26 are formed between two adjacent wedge wires 18. In FIGS. 1, 2*a* and 2*b* the notches 24 and the wedge wires 18 are in the inner side of the support ring 14, which means, in practice, that the feed-side face of the screen cylinder 10 is the inside face of the screen cylinder, and the accept fraction when passing the gaps, i.e. the screen openings 26, travels in a radially-outwardly direction, whereby the screen cylinder may be called an outflow screen cylinder. In a case where the screen cylinders have notches in the outer side of the support structure or support rings, and wedge wires and possibly disruptor bars in the notches, the function is the same but the direction of operation is opposite whereby such screen cylinders are called inflow cylinders. The drilled or slotted screen cylinders may also be either outflow or inflow cylinders, in which, in a manner similar to wedge wire screen cylinders, in an outflow cylinder the support rings are on the outer face of the screen cylinder and in an inflow cylinder the support rings are on the inner face of the screen cylinder. In other words, the support rings of a screen cylinder are always provided on the face of the screen cylinder opposite the feed-side face of the screen cylinder. FIG. 2*a* also shows a disruptor bar 30, or rather its foot part F, fastened to a notch in the support ring 14. The disruptor bar, or rather its head part H, extends from between the wedge wires 14 to a second predetermined distance from the notched circumference 20 of the support ring 14. The second predetermined distance is greater than the first predetermined distance whereby it may be said that the surface of the disruptor bar opposite the support ring 14, or the head part H, is raised from the feed-side face of the screen cylinder.

FIG. 2*b* illustrates a partial section of a support ring 14 (reference numeral 14 refers to any one of the numerals 14', 14" and 14'") of an outflow wedge wire screen cylinder of FIG. 1. The support ring 14 has notches 24 for the wedge wires, and sometimes also notches 28 for the foot parts F of disruptor bars 30 (see FIG. 2*a*), the notches 24 and 28 opening in the radially inner circumference 20 of the support ring 14 whereby the inner circumference is called a notched circumference 20. The radially outer circumference is called a solid circumference 22 as it has no notches or any other axially extending recesses. Naturally, if it is a question of an inflow screen cylinder, the notched circumference is the outer circumference of the support ring and the solid circumference is the inner circumference of the support ring.

In another optional screen cylinder construction, the disruptor bars 30, or rather their foot parts, are fastened on the screen surface, i.e. either on the feed-side face of the wedge wires (see FIG. 4) or on the feed-side face of the drilled or slotted sheet metal cylinder, which is on their opposite side or face fastened to support rings. Thereby, it is clear that the surface of the head part of the disruptor bar opposite the surface facing the feed-side face of the screen cylinder is raised from the feed-side face.

Figure 3:
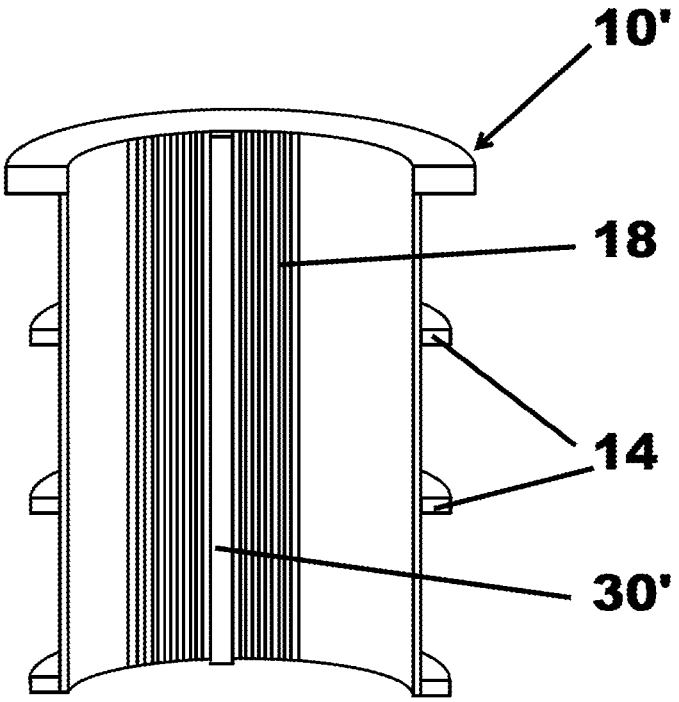
Fig. 3 Prior Art
FIGS. 3 and 4 illustrate sectional views of conventional wedge wire screen cylinders with disruptor bars positioned between or on top of the wedge wires.
Figure 4:
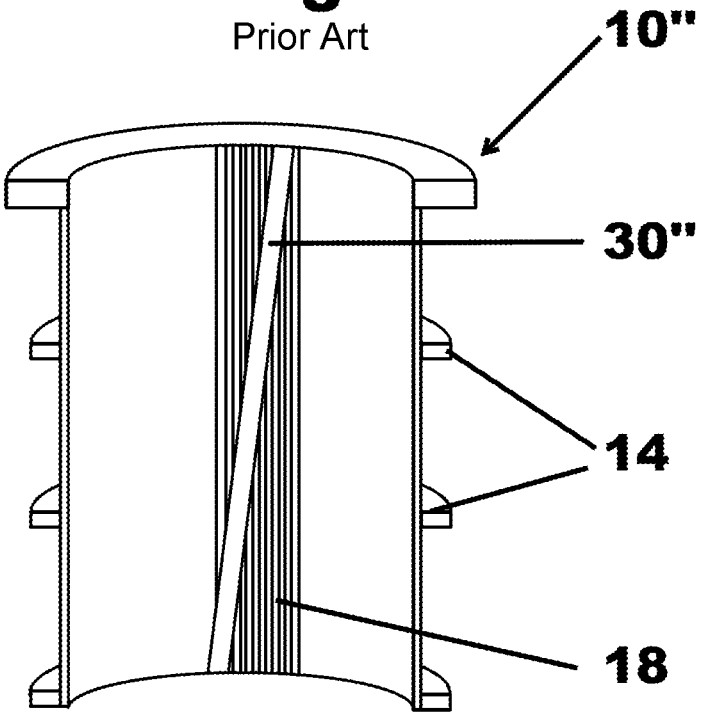
Fig.4 Prior Art

FIGS. 3 and 4 illustrate two sectional views of conventional screen cylinders 10' and 10" with disruptor bars 30' and 30" between the wedge wires 18 or on top of the wedge wires 18, or more generally on the feed-side face of the screen cylinder. These disruptor bars 30' and 30" are conventional disruptor bars with a rectangular cross section. The disruptor bar 30' (FIG. 3) has an axial alignment and it may be fastened either between the wedge wires to the support rings 14, as shown in FIGS. 2*a* and 2*b*, or on the feed-side face of the screen media made of a perforated sheet metal plate or of wedge wires. The disruptor bar 30" (FIG. 4) is inclined to the axis and fastened on the wedge wires 18 or on the feed-side face of the screen media made of a perforated sheet metal plate. There is only one disruptor bar shown in FIGS. 3 and 4, but typically there may be at least two or even as many as twenty or thirty disruptor bars in a screen cylinder.

In order to provide the most durable construction, the coarse screen cylinder has traditionally been made with relatively large (typically 1.8 mm) holes that may be recessed within a contoured screen cylinder surface (see for instance U.S. Pat. No. 4,529,520). More recently, slotted (the most popular alternative of which are wedge-wire) cylinders have come into use. The slot widths in these cylinders are also relatively large (typically 0.5 mm) compared with fine screen cylinders, but they remove a greater amount of contaminants compared to the drilled cylinders with large holes. The contours featured in either the drilled or slotted cylinders are typically deeper, i.e. more aggressive, than used in fine screen cylinders, to promote a greater degree of fibre passage.

These coarse screen cylinders may also be distinguished by the presence of disruptor bars on the feed-side face of the screening media. The performance of these disruptor bars are believed to do one or more of the following, which is to: 1) increase deflaking by the collision of flakes with the leading, which is to say the active, edge of the disruptor bars, 2) break-up agglomerations of "stringy" debris such as plastic tape and other large recycled contaminants, and 3) create large-scale turbulence that prevents the slots or holes from plugging and thus increases screen capacity.

Coarse screen cylinders with disruptor bars may feature either: 1) many disruptor bars with a drilled or slotted screening media, where the disruptor bars remove the need to have small-scale contours adjacent the individual slots or rows of holes, or 2) a more limited number of disruptor bars that are welded onto the feed-side face of the screening media with either plug welds or gusset welds on either side of the foot part of the disruptor bar. The disruptor bars are typically fastened on the feed-side face of the screening media.

The screen cylinder of the present invention discloses disruptor bars having a complex, three-dimensional shape. In practice, the cross-section of a disruptor bar is designed to have more than one leading or active edge when seen in the circumferential direction, i.e. in the direction of movement of the fiber suspension in relation to the screen cylinder or, in other words, with the active edges facing the predominantly circumferential flow of fibre suspension. Additionally, the cross-sectional shape of the disruptor bar may vary in the longitudinal direction of the disruptor bar. This disruptor bar shape addresses previously-listed problems.

A screen cylinder of the present invention comprises a screening media, i.e. either a cylindrical drilled/slotted sheet metal screening media or a screening media made of wedge wires supported to a cylindrical form by means of a support structure, and disruptor bars running in the longitudinal direction of the screening media, i.e. either in axial or in somewhat inclined direction, (i.e. between +/−30 degrees from the axis), to the screen cylinder. Both the drilled or slotted screening media and the screening media made of the wedge wires usually have a surface structure that is typical for screen cylinders known in the prior art. The disruptor bars, on their part, have, at their head part, more than one active edge receiving or facing the fibre suspension moving along the feed-side face of the screen cylinder, and possibly also a cross-section that varies in the axial and/or circumferential direction of the screen cylinder. The cross section may vary continuously for the entire length and/or width of the disruptor bar, or may vary only partially along the length and/or width of the disruptor bar. The head parts of the disruptor bars further at least partly extend beyond, i.e. are raised from, the feed-side face of the screen cylinder in a direction away from the supporting structures. Another way of expressing the extension is to say that the head parts of the disruptor bars extend farther away from the radially-notched circumference of the support structures than do the wedge wires. The disruptor bars used for a single screen cylinder may all have the same structure and shape, but the disruptor bars may as well be a combination of the disruptor bars having different kinds of cross-sections or configurations, as disclosed herein including in the following Figures.

Each disruptor bar according to the present invention includes more than one active edge within a single disruptor bar. Such active edges may be leading edges when seen in the direction of circumferential movement of fibre suspension, or edges pointing in radial direction away from the screening media. This addresses the problem of deflaking without increasing the number of disruptor bars and the associated power consumption. A single disruptor bar of the present invention may be formed of several parts or elements that are welded to one another such that the disruptor bar has at least two sharp active edges. There may be variations of the constituent disruptor bars. For example, if the disruptor bar is formed of three parts or elements attached to each other, the first and middle parts may be generally rectangular or square (sharp cornered) but the last part (in the direction of flow) may be sloped to provide a gentle transition and to avoid the creation of bound vortices which cause unwanted downstream wear.

The complex disruptor bar shape having two or more active edges, and possibly changes in its cross-section, also generates more complex flow patterns and more effective wake turbulence than a simple rectangular disruptor bar. These more-complex flow patterns are more effective in breaking up any debris agglomerations and in maintaining the slots free from plugging with pulp and debris.

It is believed that extreme wear of disruptor bars of a conventional screen cylinder results from "bound vortices" that exist immediately downstream of a simple rectangular disruptor bar and are interrupted only with the periodic passage of the rotor. A more complex disruptor bar shape reduces or eliminates these patterns. In addition, the trailing edge of the complex disruptor bar-shape could be sloped rather than fashioned as a step to reduce wear.

In an embodiment of the present invention, the foot part of the disruptor bar is anchored directly into the support structures of the screen cylinder. In such a case, the screen cylinder is typically constructed of: 1) a cylindrical screening media formed of adjacent wedge wires and support rings, which serve a dual purpose of arranging the wedge wires to have appropriate screening slots therebetween and to support the wedge wires in cylindrical form, and 2) end-rings that are used to connect the cylinder to the pulp screen housing. Thus the disruptor bars are provided between the wedge wires and fastened at their foot part to support rings such that they form interruptions in the otherwise substantially-cylindrical screening face. The support structures of the present invention comprise usually support rings and end rings, but they may also relate to, for example, a shell-type screen cylinder design.

In another embodiment of the present invention the foot part of the disruptor bar is anchored, for example, on the screening media of the screen cylinder. In that case the screen cylinder is typically constructed of 1) a screening media, i.e. either a cylindrical drilled or slotted sheet metal plate or a cylindrical media formed of adjacent wedge wires, and support rings which may be welded onto the drilled plate or serve a dual purpose of arranging the wedge wires, and 2) end-rings that are used to connect the cylinder to screen body. Thus the disruptor bars form interruptions in the otherwise substantially cylindrical screening face.

The inventive screen cylinder construction addresses the following problems.

Disruptor bar breakage and detachment is minimized or alleviated by using a direct and mechanical connection of the disruptor bar to the much stronger support rings. In this manner, the strength of the disruptor bar is not dependent merely on the applied weld and a welded connection of the disruptor bar to the irregular inner surface of the screen cylinder. The weld that is applied to the back of the disruptor bar may function only to connect the pieces together and not to absorb the applied load of impinging debris or debris trapped between the rotor and cylinder.

A second strength benefit is that the proposed design eliminates the possibility of impinging material becoming wedged beneath a welded disruptor bar when either plug welds are used or a gusset weld is not applied along the full length of the disruptor bar.

A third strength benefit is that the integrated disruptor bars transmit load between the screen cylinder end-rings. An issue with the current wedge-wire screen cylinder design is that any torsional, compressive or other load that is applied to the overall cylinder and that is resisted by the cylinder end-rings must be transmitted by the wires. This can lead to fatigue and failure of the relatively small wires. By also having proposed disruptor bars that are anchored to the support rings, there would be several of these much more substantial mechanical members connecting the end-rings of the cylinder, transmitting any extraordinary mechanical loads and avoiding the fatigue and failure of the wires. The design of the present invention may also be applied to fine screen applications where the issue is a worn screen body or other situation that presents mechanical challenges, however, the disruptor bar would not extend above the height of the wires.

Figures 5A, 5B, 5C, 5D:
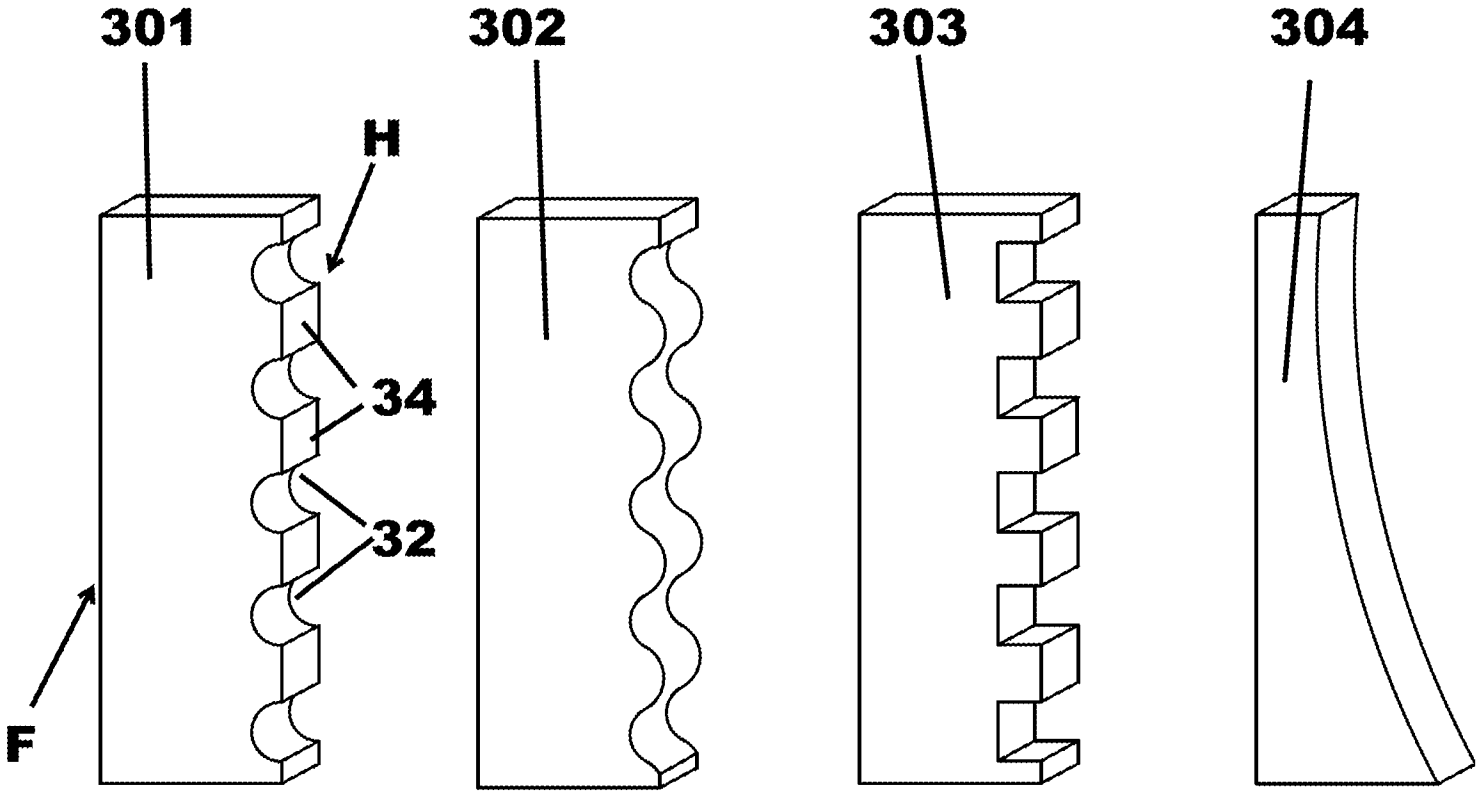
FIGS. 5*a* to 5*d* illustrate a few various alternatives for a disruptor bar element according to the present invention.

FIGS. 5*a*-5*d* illustrate schematically-optional elements for constructing a working disruptor bar. Although a particular length of disruptor bar elements is shown in FIGS. 5*a*-5*d*, it should be understood that the length of these elements should preferably extend the length of the screening media as shown in FIGS. 3 and 4. FIG. 5*a* illustrates a single disruptor bar element 301 according to a first preferred embodiment of the present invention. The single disruptor bar element 301 has a structure with alternating semi-circular recessions 32 and flat parts 34 at the head part of the disruptor bar element and along the length thereof. The recessions 32 are located on the head-part surface facing away from the surface of the disruptor bar element which is fastened to the screening media, i.e. to the screening face or to the supporting structures. The disruptor bar element 302 of FIG. 5*b* has, preferably but not necessarily, a conventional rectangular cross-section with undulating variable change in the longitudinal direction of the disruptor-bar element, at the head part thereof. The surface of the head part of the disruptor bar element where the undulating variable change may be seen faces away from the surface the disruptor bar element which is fastened to the screening media, i.e. to the screening face or to the supporting structures. The disruptor bar element 303 of FIG. 5*c* has, preferably but not necessarily, a conventional rectangular cross-section with step change in the generally longitudinal direction of the disruptor bar element, at the head part thereof. The head part surface of the disruptor bar element, where the step change may be seen, is the surface away from the surface the disruptor bar element is fastened to the screen cylinder, i.e. to the screening face or to the supporting structures. The recessions may, in addition to the above shown shapes, be whatever appropriate shape, including but not limited to, also semi-elliptical and V-shaped recessions. The disruptor bar element 304 of FIG. 5*d* has, preferably but not necessarily, a conventional rectangular cross-section with a steady, progressive change in its height or thickness in the radial direction.

Thus, to construct a disruptor bar fulfilling the requirements of the present invention, i.e. the disruptor bar having at least two active leading edges, at least two disruptor bar elements of FIGS. 5*a*-5*d* should be fastened to one another side by side. The body part (referring to the part of the disruptor bar between the surface from which the disruptor bar is fastened to the screening surface or to the supporting structures and the lowermost surface of the opposite surface) of the disruptor bars built from the above mentioned disruptor bar elements, or of any disruptor bar belonging to the scope of the present invention, may extend beyond the screening face but in the least the thickest parts (in the radial direction) of the disruptor bars extend beyond the screening face in the direction away from the support rings. Thus the head part of the disruptor bars may extend beyond the screening face for the entire length thereof or only for a partial length thereof.

The elements of FIGS. 5*a* to 5*c* are positioned, when constructing a working disruptor bar with two or more active edges, in relation to one another such that the depression of a first element is followed by a flat or raised part of a second element whereby two active edges are formed. As to the element of FIG. 5*d*, there are two alternatives how to form two or more active edges when fastening the elements to one another. A first alternative is to have the curved top surface (facing away from the surface the element or the disruptor bar is fastened on the support bar or the screening surface) or the surface having a steady, progressive change in its height or thickness in the radial direction of an element slope from its leading edge towards its trailing edge whereby two or more identical elements may be fastened to one another to form a disruptor bar. Another alternative is to increase the radial height of the second (and third, and so on) element compared to that of the first element or previous elements, whereby two or more successive active edges are formed when fastening the two or more elements to one another.

Figure 6:
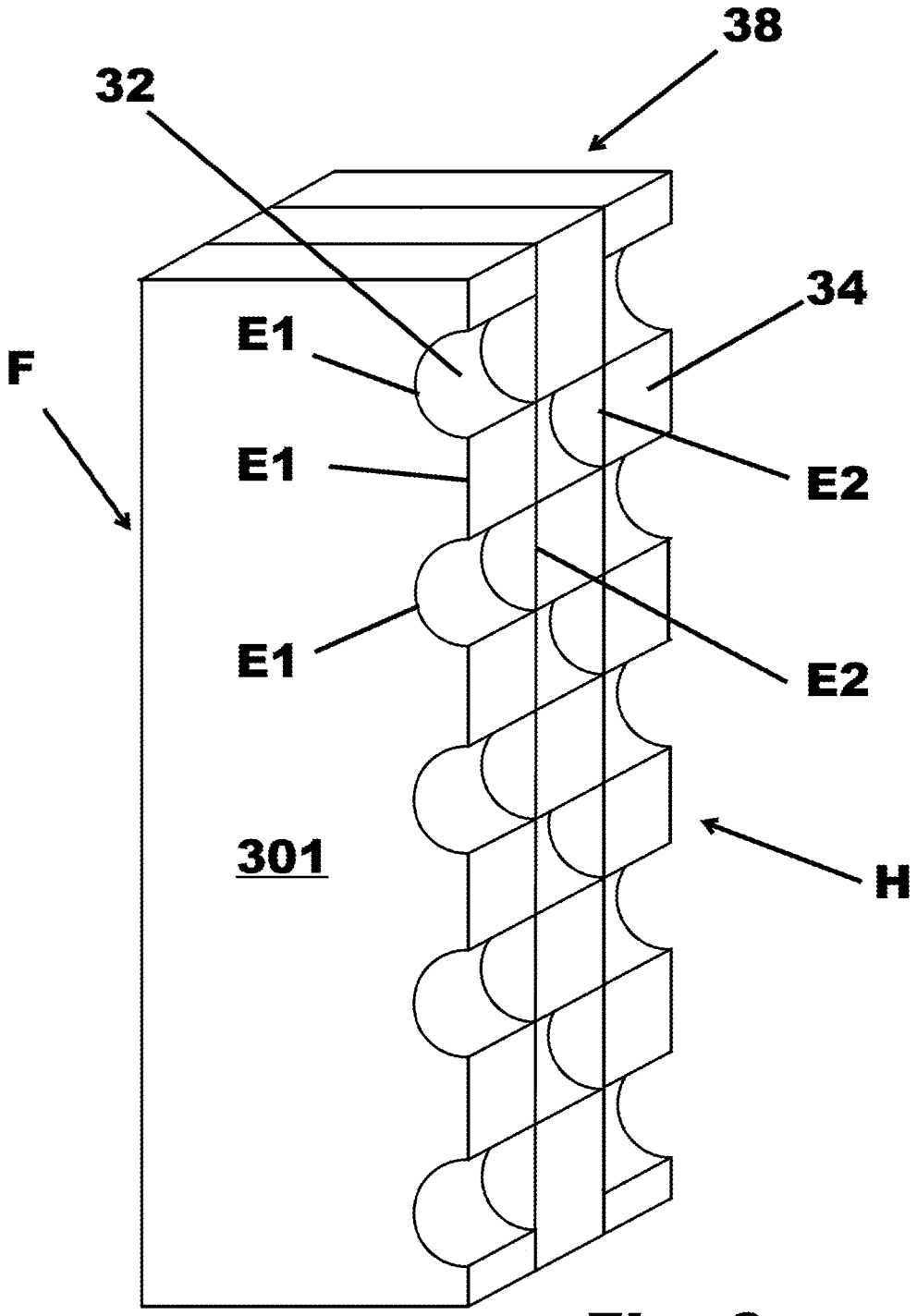
FIG. 6 illustrates an optional construction for the disruptor bar.

FIG. 6 illustrates thus a further developed disruptor bar construction 38 which is formed of three single disruptor bar elements 301 of FIG. 5*a* attached to each other so that the recessions 32 and the flat parts 34 are alternating in a circumferential direction, too. Again, it should be understood that the length of these elements forming the disruptor bar should preferably extend the length of the screening media as shown in FIGS. 3 and 4. This construction forms, in the circumferential direction, more active or leading edges (E1 and E2) and also trailing edges at the head part H of the disruptor bar 38 than the prior art single rectangular disruptor bar. This kind of a multi-component disruptor bar may be formed from any combination of two or more single disruptor bar elements 301-304 illustrated in FIGS. 5*a*-5*d* or from any other combination of two or more single disruptor bar elements resulting in a similar construction having more than one active edge at their head parts. The parts or elements of the disruptor bar are welded to one another along the rear face of the parts or elements, i.e. along the foot part F face or along the face opposite to the face having recessions or other surface configurations. The parts or elements of the disruptor bar may also be welded to one another at the ends of the disruptor bar.

It is easy to understand when viewing elements of FIGS. 5*a*-5*d* and FIG. 6 that the active edges may be either discontinuous (see for instance edge E2 in FIG. 6) or continuous (when the disruptor bar is made by fastening elements 304 of FIG. 5*d* to one another. Also the active edges may be parallel with the screening face (E2 of FIG. 6) or at least partially inclined thereto (edge E1 in FIG. 6).

The disruptor bars, or actually parts of the disruptor bars, of the present invention, especially those having a more challenging configuration, like for instance those discussed in FIGS. 5*a* through 5*d*, may be produced by laser-cutting from a rectangular or another blank of appropriate shape. Also the disruptor bar combined from two or more parts may be laser-welded, as discussed already above.

Figure 7A:
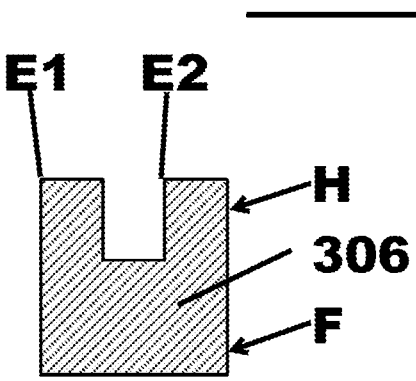
FIGS. 7*a*-7*h* illustrate schematically possible exemplary cross-sections for the disruptor bar of the present invention.
Figure 7B:
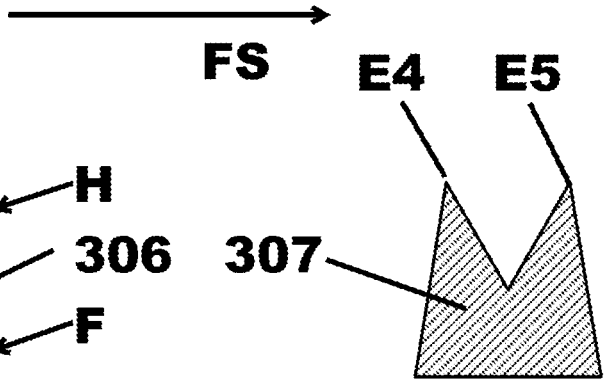

FIGS. 7*a* through 7*h* illustrate further possible cross-sections of the disruptor bars of the present invention, the cross-sections being taken in a plane at right angles to the longitudinal direction of the disruptor bar. The disruptor bar 306 of FIG. 7*a* has a U-shaped cross-section providing more deflaking active or leading edges E1 and E2 at the head part H of the disruptor bar in the circumferential direction. The cross-section of the disruptor bar of FIG. 7*a* may be modified by making the groove between the legs of the cross-section V-shaped, whereby the active edges E4 and E5 formed at the head part of the disruptor bar 307 are pointing in radial direction as shown in FIG. 7*b*, i.e. away from the screening media being attached to the foot part F of the disruptor bar. In other words, the cross section of the head part of the disruptor bar is M-shaped.

Figure 7C:
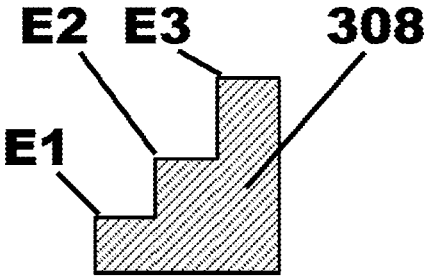

The bar 308 of FIG. 7*c* has a cross-section with a stepped leading surface of the head part of the disruptor bar resulting in three leading or active edges E1, E2 and E3. Like in the earlier embodiment, shown in FIG. 7*b*, the tip part of the cross-section of the disruptor bar 309 (see FIG. 7*d*) may be made sharp whereby the outermost (in a direction away from the screening media) active edge E6 of the disruptor bar 309 points in a radial direction away from the screening media.

Figure 7D:
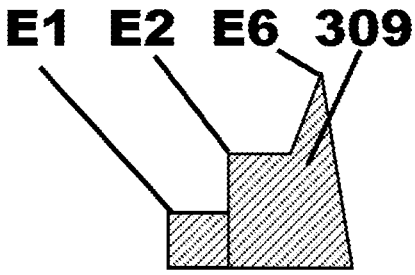
Figure 7E:
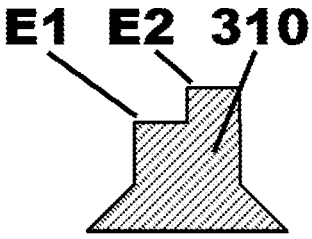
Figure 7F:
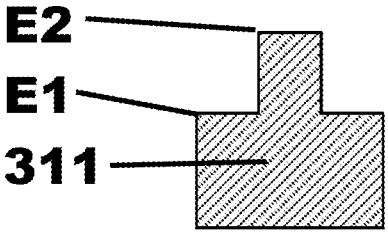

The bar 310 of FIG. 7*e* has a cross-section with a stepped upper part or head part extending higher than the diagonal sides at the foot part of the disruptor bar. The bar 311 of FIG. 7*f* has a cross-section with rectangular middle part and lower rectangular side parts or in other words, stepped leading and trailing surfaces. These specific cross-sections are only schematic examples of disruptor bars, which promote deflaking and string break-up as well as protect slots against accelerated wear.

Figure 7G:
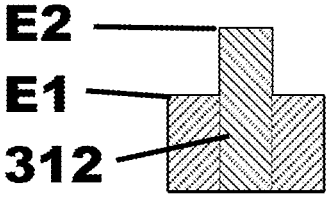
Figure 7H:
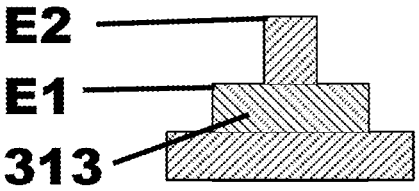

FIGS. 7*g* and 7*h* illustrate two embodiments of the disruptor bar of the present invention wherein the disruptor bars 312 and 313 are formed of three separate parts attached to each other either vertically or horizontally. The parts of the disruptor bar may be made of different materials, if so desired. Naturally it is easy to imagine how also the disruptor bars discussed in FIGS. 7*a* to 7*f* may be made of two or more parts fastened to one another.

As was already discussed in connection with FIGS. 7*b* and 7*d* it is possible to arrange parts of the head parts H of the cross-section of the disruptor bar of any other embodiment discussed in FIGS. 7*e* through 7*h*, or any further development of such embodiments, extend in radial direction such that such sharp active edges are formed that point in a radial direction away from the screening media.

Figure 8B:
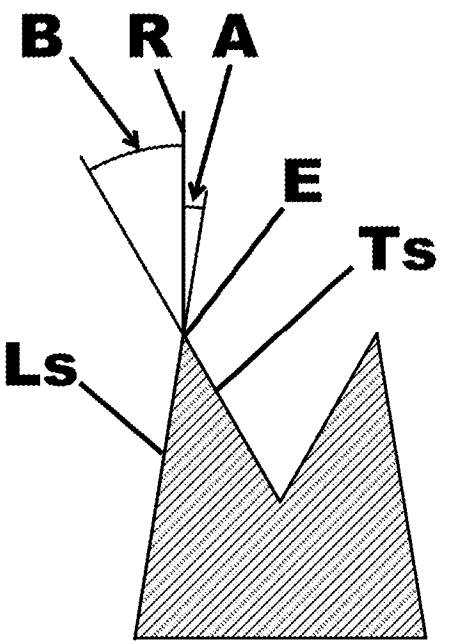
FIGS. 8*a* and 8*b* illustrate in more detail two optional configurations of an active edge.
Figure 8A:
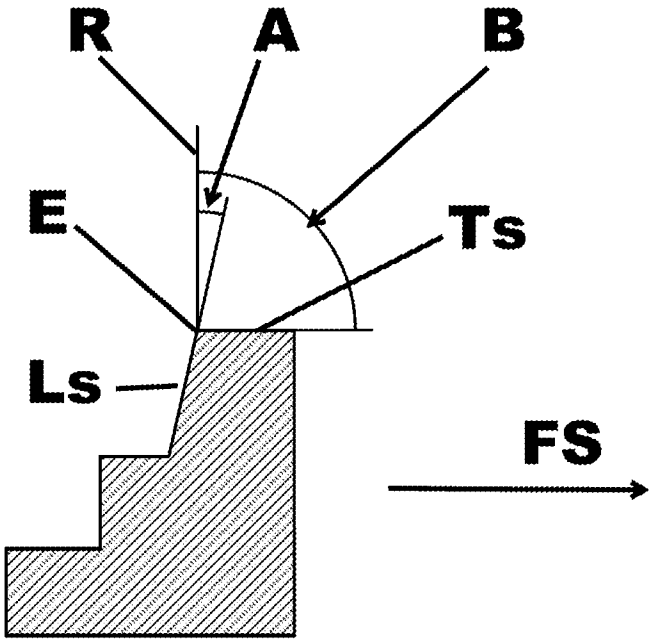

Thus, FIGS. 8*a* and 8*b* illustrate two different cross sections of a disruptor bar suspension is coming from the left, in the direction of arrow FS, edge E is formed between a leading surface Ls and a trailing surface Ts. The leading surface Ls forms an angle A of −20 to +30 degrees from the radial direction R. The trailing surface Ts forms an angle B of +60 to +180 degrees from the radial direction R. A negative angle indicates that a surface in inclined in a direction against the flow direction FS. In accordance with FIG. 8*a*, the leading surface Ls may be said to be a surface facing, at least in part, towards the circumferential direction of flow and the trailing surface Ts a surface facing, at least in part, towards the radial direction. In accordance with FIG. 8*b* the leading surface Ls may be said to be surface facing, at least in part, in the circumferential direction away from the direction of flow and the trailing surface Ts a surface facing, at least in part, towards the radial direction.

Figure 9A:
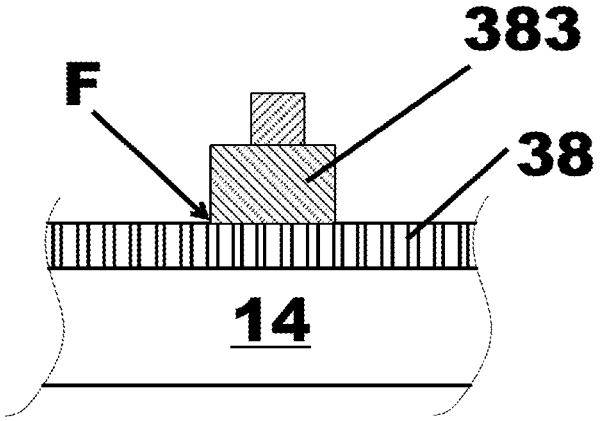
FIGS. 9*a*-9*c* illustrate three different ways to attach the disruptor bars of the present invention to the screen cylinder.

As to the present invention: in FIG. 9*a* the foot part F of the disruptor bar 383 formed of two separate parts fastened to one another, or any disruptor bar or set of bar parts or elements fulfilling the requirement of having at least two active edges, of the present invention is fastened on the screening face or a feed-side face of a perforated sheet metal plate 40 forming the screening media with the, optional, support rings 14.

Figure 9B:
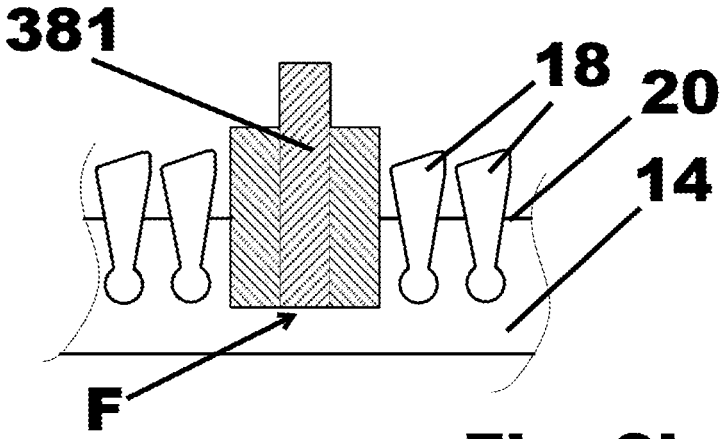

In FIG. 9*b* the disruptor bar 381 of FIG. 7*g* or any disruptor bar or set of bar parts fulfilling the requirement of having at least two active edges of the present invention is fastened in a notch 28 provided in the support ring 14. When considering the options the construction shown in FIG. 9*b* allows, it is easy to understand that the height of the bar measured from the notched circumference 20 in relation the height of the wedge wires may be freely adjusted. However, to fulfil the requirement of the invention of having at least two leading edges of a disruptor bar extend farther from the notched circumference than the wedge wires both (lower and upper) parts or steps of head part H of the disruptor bar have to be raised from the generally cylindrical screening face or feed-side face of the screening media. Yet, a leading part of the disruptor bar may be like one of those shown in FIGS. 5*a*-5*d*, whereby it is possible to arrange the lowermost surface parts of the head part of the disruptor bar to remain within the screening media, i.e. not raised at all, and allow only parts of the head part surfaces to be raised above the feed-side face of the screening media.

Figure 9C:
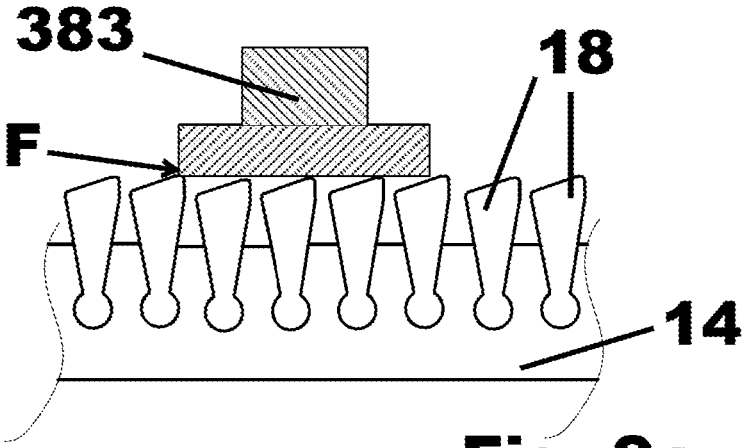

And in FIG. 9*c* the foot part F of the disruptor bar 383 (shown already in FIG. 9*a*) or any disruptor bar of the present invention is fastened on the screening media, i.e. on the screen wires 18.

Figure 10B:
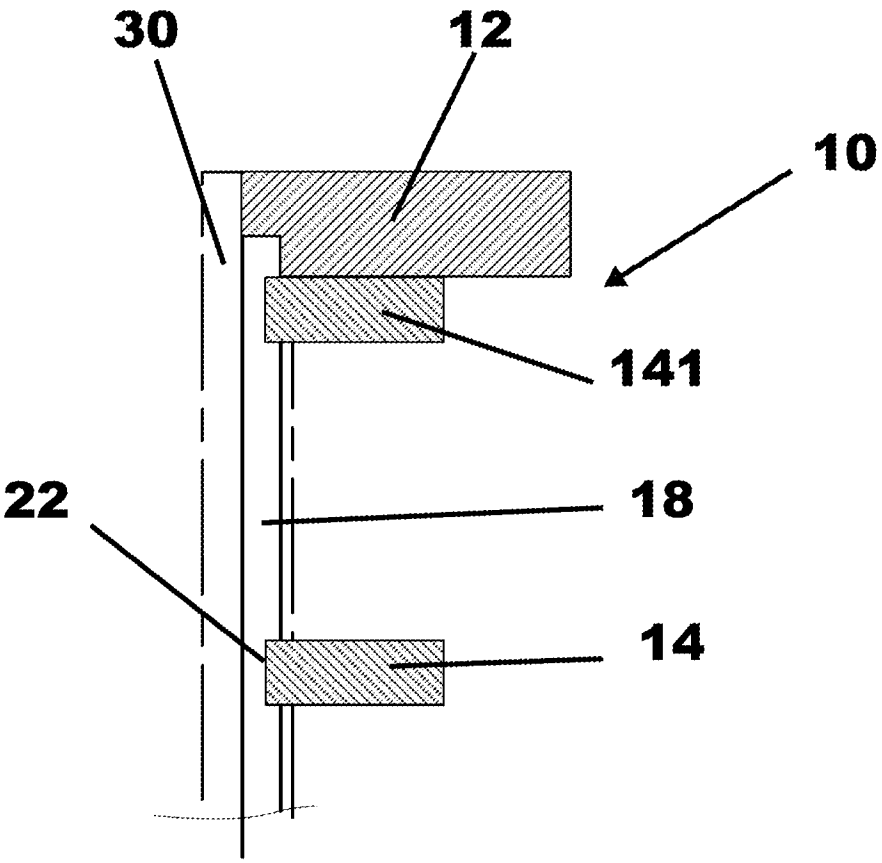
FIGS. 10*a* and 10*b* illustrate two optional ways of constructing the end section of the screen cylinder.
Figure 10A:
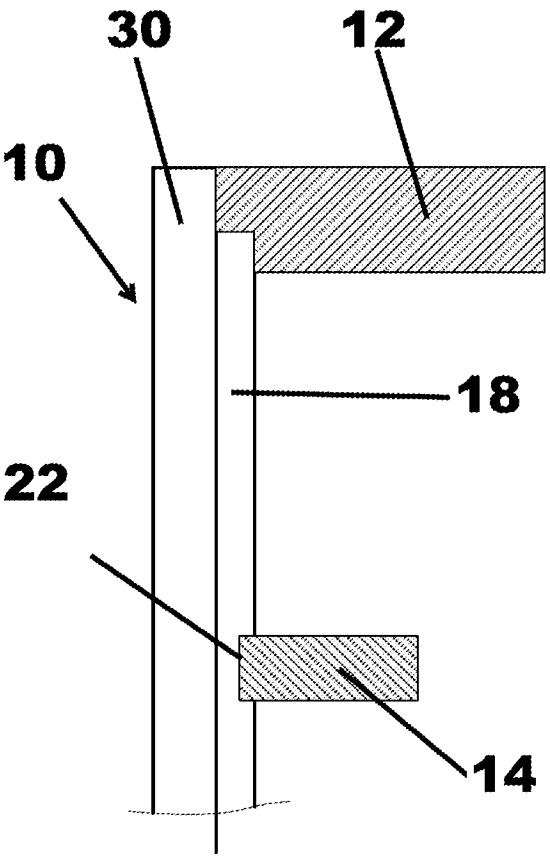

FIG. 10*a* illustrates a way the end-part of a screen cylinder 10 may be constructed. The wedge wires 18 are fastened, as usual, in the notches in the notched circumference 20 of the support ring 14. The disruptor bar 30 is fastened on the wedge wires 18. Both the wedge wires 18 and the disruptor bar 30 extend on the circumference of the end ring 12 and are fastened thereon either by means of welding or by means of providing first notches in the surface or circumference of the end-ring for the disruptor bar 30 and/or the wedge wires 18 and then welding the disruptor bar 30 and the wedge wires 18 to the end ring 12.

FIG. 10*b* illustrates another way the end part of a screen cylinder may 10 be constructed. Here the wedge wires 14 are fastened, as usual, in the notches in the notched circumference 20 of the support rings 14. However, now one of the support rings 141 is arranged to rest against the end ring 12 so that the support ring 141 may be welded to the end ring 12. The disruptor bar 30 is, in this embodiment, fastened to notches in the support rings 14 and 141, as illustrated in FIGS. 2*a* and 2*b*, and in a similar notch provided in the end ring 12.

Although the invention is above described with reference to specific illustrated embodiments, it is emphasized that it also covers equivalents to the disclosed features, as well as changes and variants obvious to a man skilled in the art, and the scope of the invention is only limited by the appended claims.

The invention claimed is:

1. A screen cylinder comprising, a cylindrical screening media provided with perforations, end rings fastened to opposite axial ends of the cylindrical screening media, and at least one annular support ring between the end rings, the end rings and at least one annular support ring forming a support structure supporting the cylindrical screening media;

the cylindrical screening media having a feed-side face and an exit-side face, the feed-side and said exit-side faces extending in a circumferential direction; and at least one disruptor bar being distinct from the support structure and the cylindrical screening media, and attached to at least one of the support structure and cylindrical screening media, the disruptor bar extending in a mainly longitudinal direction of the cylindrical screening media at the feed side face thereof;

the at least one disruptor bar having a foot part and a head part, the foot part and the head part forming radially opposite ends of the disruptor bar, the at least one disruptor bar being fastened to the support structure or cylindrical screening media by means of its foot part, the screen cylinder comprising:

two or more active edges provided in a cross-section of the head part of the at least one disruptor bar, the cross-section being taken in a direction perpendicular to a longitudinal axis of the at least one disruptor bar.

2. The screen cylinder according to claim 1, wherein the two or more active edges are formed by a surface facing, at least in part, towards the circumferential direction of flow and a surface facing, at least in part, towards the radial direction away from the screening media.

3. The screen cylinder according to claim 1, wherein the two or more active edges are formed by a surface facing, at least in part, in the circumferential direction away from the direction of flow and a surface facing, at least in part, towards the radial direction away from the screening media.

4. The screen cylinder according to claim 1, wherein the two or more active edges extend in the longitudinal direction of the at least one disruptor bar.

5. The screen cylinder according to claim 1, wherein the active edges at the head part of the at least one disruptor bar are at least partially raised above the generally cylindrical feed-side face of the cylindrical screening media.

6. The screen cylinder according to claim 1, wherein the cross-section of the at least one disruptor bar is, at the head part thereof, stepped, U-shaped, V-shaped, M-shaped, provided with at least one blade or any combination thereof.

7. The screen cylinder according to claim 1, wherein the at least one disruptor bar is formed of at least two parts fastened to one another.

8. The screen cylinder according to claim 7, wherein the head part of the at least one disruptor bar has, in the longitudinal direction thereof, multiple parallel recessions.

9. The screen cylinder according to claim 7, wherein the at least one disruptor bar is formed of at least two parts of which at least one has, in its longitudinal direction, consecutive recessions opening at the head part of the at least one disruptor bar.

10. The screen cylinder according to claim 9, wherein the at least one disruptor bar is formed of three parts, each having, in its longitudinal direction, consecutive recessions opening at the head part of the at least one disruptor bar.

11. The screen cylinder according to claim 8, wherein said recessions are shaped as semicircles, semielliptic, rectangular or V-shape.

12. The screen cylinder according to claim 1, wherein the at least one disruptor bar has a cross-section taken in the longitudinal direction of the disruptor bar and along a radius of the screen cylinder, the shape of the cross-section changing in the longitudinal direction of the at least one disruptor bar.

13. The screen cylinder according to claim 1, wherein the exit-side face of the cylindrical screening media opposite the feed-side face is provided with a plurality of support rings.

14. The screen cylinder according to claim 1, wherein the cylindrical screening media is formed of a drilled or slotted sheet metal plate that is bent to a cylindrical shape.

15. The screen cylinder according to claim 1, wherein the cylindrical screening media is formed of wedge wires arranged circumferentially such that screening openings, i.e. slots, are left between the wedge wires.

16. The screen cylinder according to claim 15, wherein the wedge wires are supported to a plurality of support rings, each support ring having a notched circumference with notches for the wedge wires.

17. The screen cylinder according to claim 16, wherein the at least one disruptor bar is fastened to the support ring between wedge wires.

18. The screen cylinder according to claim 17, wherein the foot part of the at least one disruptor bar is arranged in a notch in the support ring.

19. The screen cylinder according to claim 1, wherein the at least one disruptor bar is fastened on the feed-side face of the screening media.

20. The screen cylinder according to claim 19, wherein the at least one disruptor bar is attached onto wedge wires.

21. The screen cylinder according to claim 1, wherein said at least one disruptor bar is attached, at its foot part, to the end rings, preferably to notches in the end rings.

* * * * *